US009523530B2

(12) United States Patent
Dubina et al.

(10) Patent No.: US 9,523,530 B2
(45) Date of Patent: Dec. 20, 2016

(54) REMOVABLE FREEZER DOOR

(71) Applicant: Electrolux Home Products, Inc., Charlotte, NC (US)

(72) Inventors: Paul Dubina, Anderson, SC (US); Thomas McMahan, Honea Path, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/685,770

(22) Filed: Apr. 14, 2015

(65) Prior Publication Data

US 2016/0305705 A1 Oct. 20, 2016

(51) Int. Cl.

| | |
|---|---|
| ***F25D 23/00*** | (2006.01) |
| ***F25D 23/02*** | (2006.01) |
| ***F25D 23/06*** | (2006.01) |
| ***F25D 31/00*** | (2006.01) |
| ***F25D 25/02*** | (2006.01) |

(52) U.S. Cl.

CPC ..... *F25D 23/028* (2013.01); *F25D 23/062* (2013.01); *F25D 23/066* (2013.01); *F25D 25/025* (2013.01); *F25D 31/00* (2013.01)

(58) Field of Classification Search

CPC ..... F25D 23/02; F25D 23/028; F25D 25/025; F25D 2323/02; A47B 88/0044; A47B 88/0051; A47B 88/0055

USPC ..... 312/404, 405, 348.4

See application file for complete search history.

(56) References Cited

U.S. PATENT DOCUMENTS

| | | | | |
|---|---|---|---|---|
| 4,902,080 | A * | 2/1990 | Berger | A47B 88/00 312/348.1 |
| 4,960,205 | A | 10/1990 | Wang | |
| 5,584,549 | A | 12/1996 | Lybarger et al. | |
| 5,688,033 | A | 11/1997 | Fleisch et al. | |
| 5,873,458 | A | 2/1999 | Kao | |
| 6,981,752 | B2 | 1/2006 | Harn et al. | |
| 7,293,846 | B2 | 11/2007 | Collins et al. | |
| 8,052,235 | B2 * | 11/2011 | Kelly | F25D 17/042 292/201 |
| 8,215,730 | B2 | 7/2012 | Brown et al. | |
| 8,356,865 | B2 * | 1/2013 | Laible | 312/334.1 |
| 8,708,436 | B2 | 4/2014 | Laible | |
| 2008/0309211 | A1 | 12/2008 | Wilson et al. | |
| 2009/0045713 | A1 * | 2/2009 | Kunkle | A47B 88/04 312/402 |
| 2009/0193836 | A1 * | 8/2009 | Ertz | F25D 25/025 62/449 |
| 2009/0289537 | A1 * | 11/2009 | Cabal Velarde | A47B 88/0055 312/408 |
| 2011/0080081 | A1 | 4/2011 | Klausing et al. | |
| 2011/0095667 | A1 * | 4/2011 | Toland | A47B 88/0044 312/348.4 |
| 2011/0210655 | A1 * | 9/2011 | Brown | A47B 88/04 312/334.8 |
| 2012/0262044 | A1 * | 10/2012 | Vulava | F24C 15/162 312/404 |

(Continued)

*Primary Examiner* — Daniel Rohrhoff

(74) *Attorney, Agent, or Firm* — Pearne & Gordon LLP

(57) ABSTRACT

A refrigerator including a cabinet having a bottom mounted freezer container, a separate bearing on left and right sides of the refrigerator cabinet adapted to support the container for movement in and out of a freezer compartment of the cabinet, the container bearings being disposed outside of a freezer liner forming the freezer compartment.

22 Claims, 7 Drawing Sheets

(56) References Cited

U.S. PATENT DOCUMENTS

2013/0300275 A1* 11/2013 Chellappan ..... F25D 25/025
312/402
2014/0265798 A1* 9/2014 Watts ..... F25D 23/04
312/404

* cited by examiner

FIG. 1
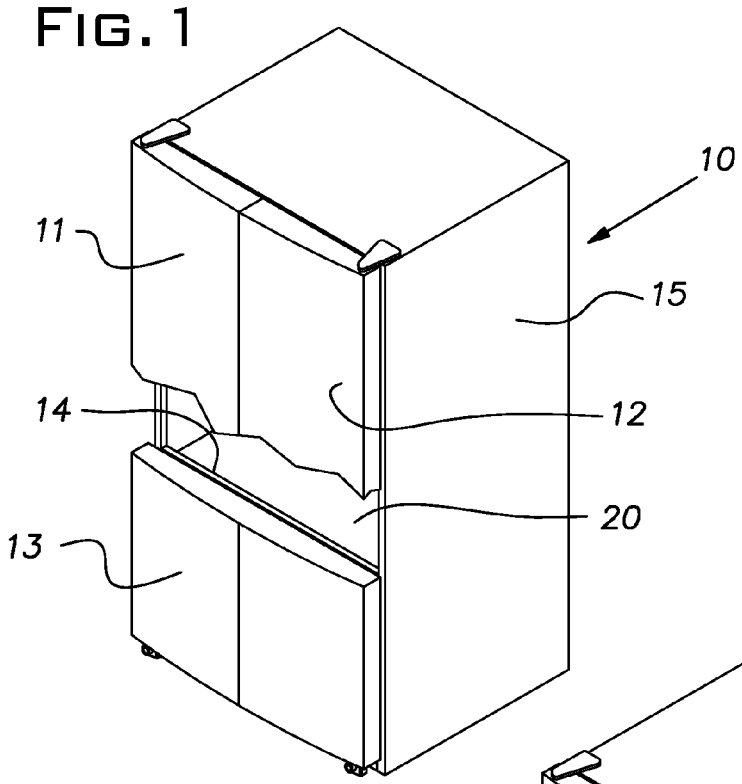
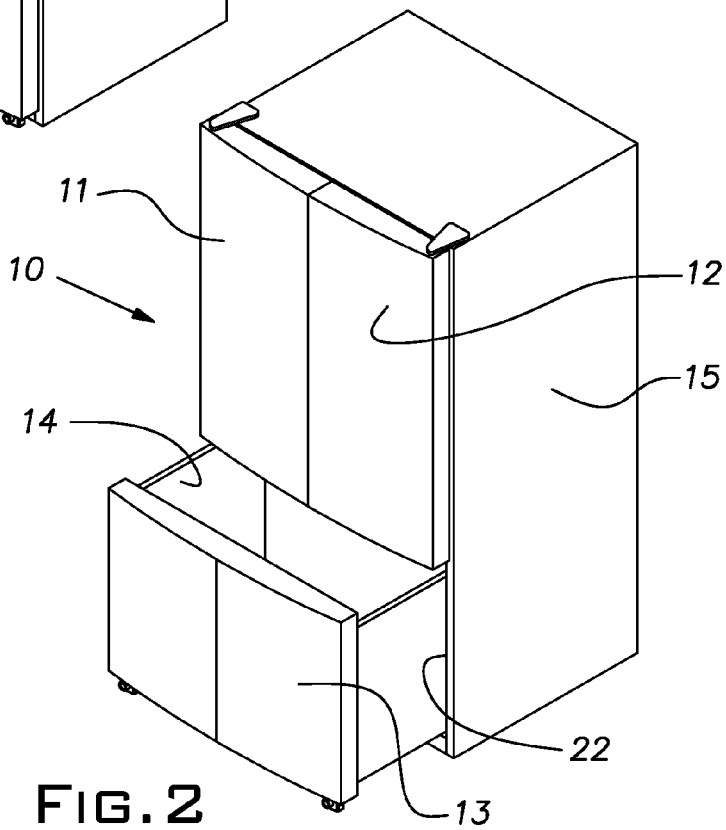
FIG. 2

REMOVABLE FREEZER DOOR

BACKGROUND OF THE INVENTION

The invention relates to refrigeration appliances and, in particular, to improvements in bottom-mount freezer compartments.

A popular style of household refrigerator has an upper refrigerated compartment or chamber with one or two vertically hinged doors and a lower drawer-like freezer compartment that slides open. Bearings are often used to facilitate sliding action of the freezer basket in and out of the freezer compartment. The location of these bearings in the freezer compartment makes lubrication problematic since the low temperature environment can increase viscosity and, therefore, decrease the effectiveness of a lubricant. There is a need for a sliding support for the freezer basket and door that is not affected by the low temperatures of the freezer compartment.

In the case of a new refrigerator, it is customary to remove the doors of the appliance unit in order to facilitate the delivery of the unit to a residence where, frequently, doors and corridors are too narrow to allow a fully assembled appliance unit to pass. Disassembly and then reassembly of the doors are performed by delivery personnel of the newly purchased appliance unit. This door removal and reassembly add to the cost of delivery. It is desirable, therefore, that doors are easily removed and replaced with a minimum requirement of skill and labor and, preferably, without tools.

SUMMARY OF THE INVENTION

The invention provides improvements in a bearing support system for a basket and door of a bottom-mounted freezer compartment of a household refrigerator. In accordance with the invention, the bearing support is external of the freezer compartment so that lubricant is not adversely affected by exposure to the low temperatures of the freezer environment. Further, the bearing support system enables the associated door to be readily removed from the support system without tools and with negligible labor time.

A refrigerator appliance including a cabinet enclosing an upper chamber and a lower chamber, the lower chamber having a container, such as a basket for holding frozen goods, the basket being slidably mounted to the appliance for movement through an opening in the cabinet between a closed position within the cabinet and an open position at least partially out of the cabinet, a door associated with the basket adapted to close the cabinet opening when the basket is in the closed position fully received in the cabinet and move away from the cabinet opening to allow the basket to be opened, the door being supported by a pair of horizontal slides located externally of the lower chamber, the slides being disposed adjacent opposite vertical edges of the door, the door being directly supported on the horizontal slides independently of the basket.

In the illustrated embodiment, the bearing support system comprises a pair of parallel round tubes, each carried in a low mounted, low profile linear bearing adjacent the front of the refrigeration cabinet. Preferably, the bearings and associated tubes occupy the same horizontal planes as supports for a pair of rollers provided at the bottom of the appliance unit to enable the unit to be rolled in and out of place. Thus, the bearing support system thus avoids adding height to the appliance and encroachment into the freezer space. Moreover, the compactness of the linear bearing enables the bearing to share a mounting assembly point with an adjacent one of the floor rollers. A housing of the linear bearing for the support tubes is bolted to a bracket which also serves as a mount for the floor roller and parts provided for vertical adjustment of the floor roller.

The freezer basket and door support tubes at their forward ends have vertical posts or stanchions on which the door is located. The stanchions are wedge-shaped and are received in cavities having complementary wedge shapes thereby enabling the door to be installed on the support tubes by simply lowering the door over the stations. Conversely, the door can be removed from the bearing support tubes and stanchions by simply lifting it. Where an appliance unit must pass through a tight clearance area, the stanchions can be removed from the support tubes and the tubes can be fully retracted into the base of the appliance.

BRIEF DESCRIPTION OF THE DRAWINGS

FIG. 1 is an isometric view of a refrigeration appliance embodying the invention;

FIG. 2 is a view of the refrigeration appliance of FIG. 1 with a bottom mount freezer door and basket open;

DETAILED DESCRIPTION

Figure 3:
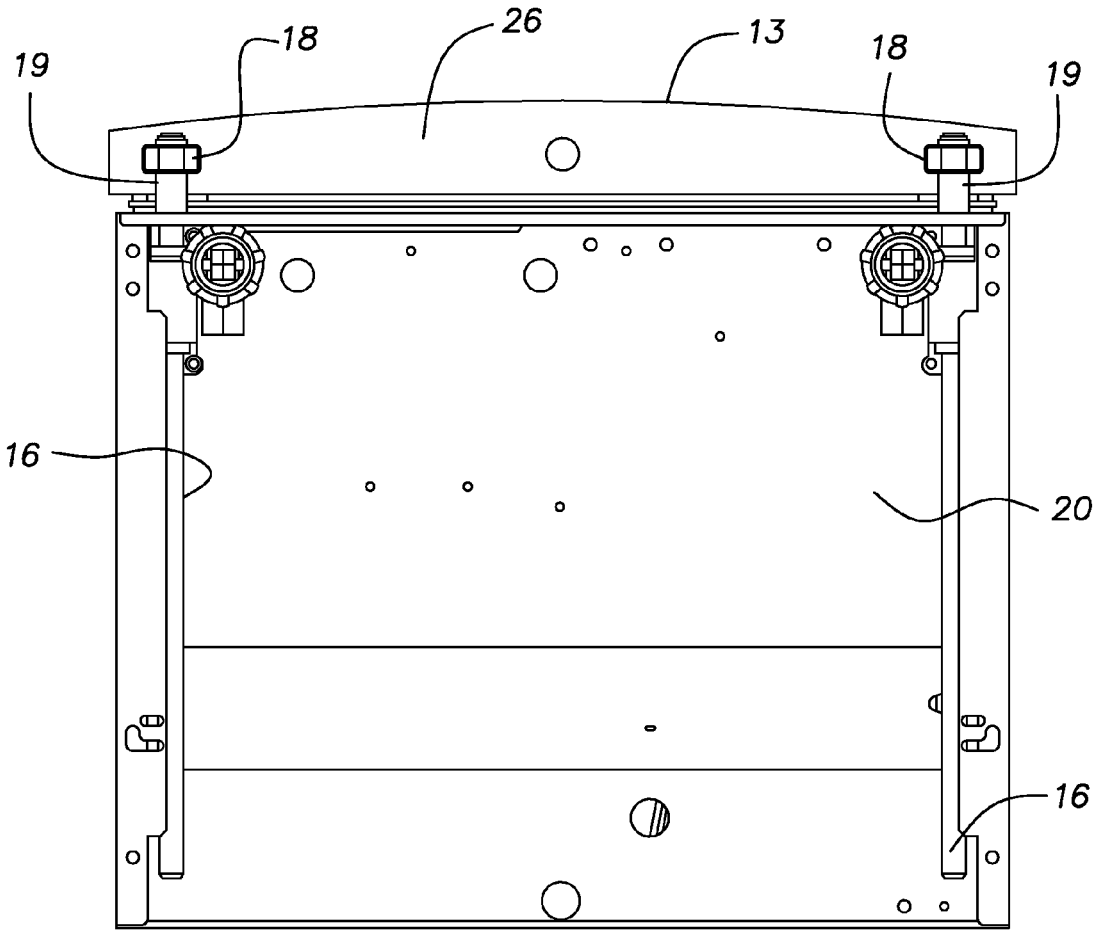
FIG. 3 is a bottom view of the refrigeration appliance.
Figure 5:
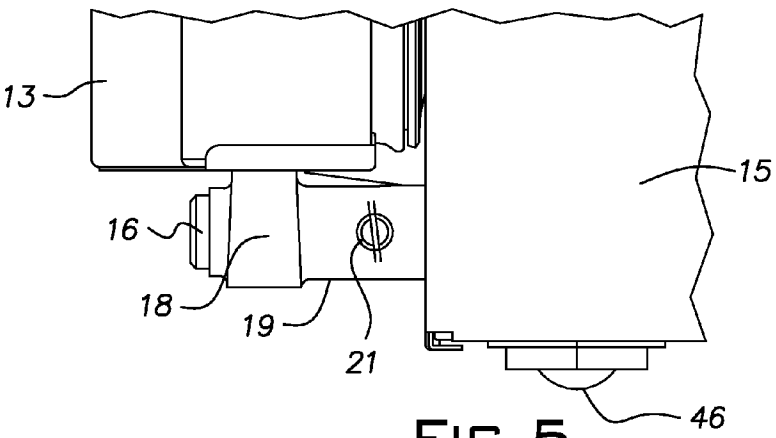
FIG. 5 is a fragmentary side view of the lower right side of the refrigeration appliance.
Figure 4:
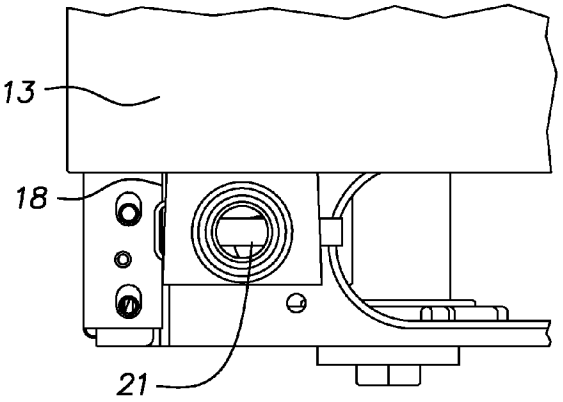
FIG. 4 is a fragmentary front view of the lower left side of the refrigeration appliance.
Figure 6:
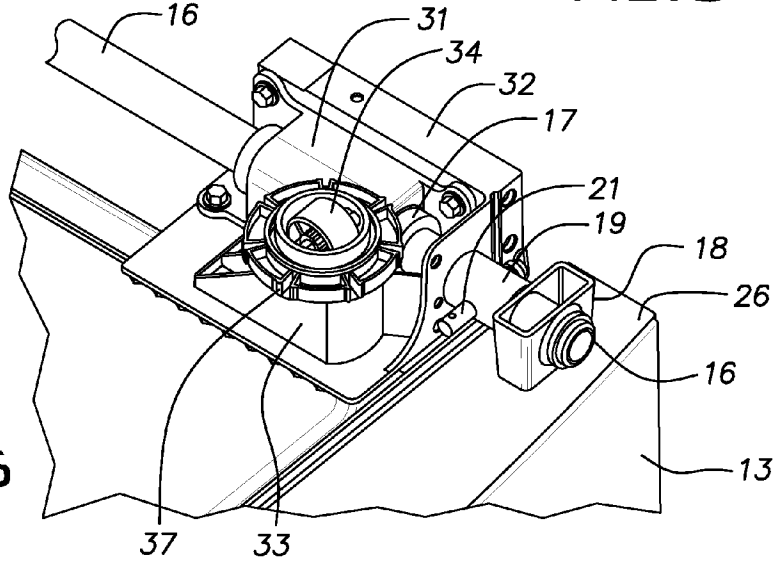
FIG. 6 is an isometric view of the bottom left front of the refrigeration appliance showing a bearing support system for the freezer door and basket and an adjustable floor roller.
Figure 7:
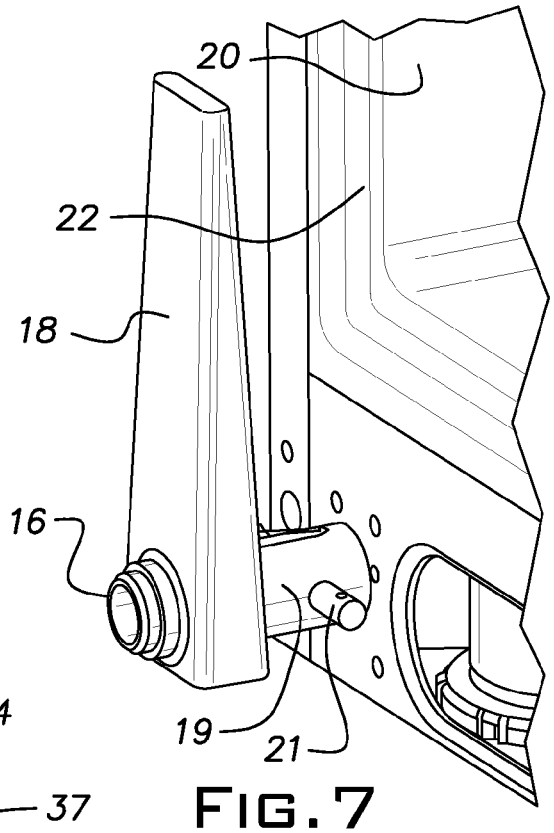
FIG. 7 is a fragmentary isometric view of the freezer door mount stanchion on the left of the refrigeration appliance.

FIGS. 1 and 2 illustrate a household or domestic refrigerator 10 having an upper refrigeration chamber and a lower refrigeration chamber within a cabinet 15. In the illustrated embodiment, the upper refrigeration chamber is closed by left and right vertically hinged doors 11, 12 of generally known construction. The lower or freezer chamber is bounded by a liner 20 with an opening 22 that is closed by a single door 13.

The lower door 13 is associated with a container such as a drawer-like bin or basket 14, as is generally customary. The door 13 is carried on a pair of horizontal cylindrical support tubes or slides 16 disposed below and external of the freezer compartment or chamber. The support tubes 16, preferably formed of steel, are slidable in respective linear bearings 17. Ideally, the bearings 17 are of the recirculating ball-type of known construction. The tubes 16 have a length approaching the front-to-back depth of the refrigerator 10. At their front ends, the bearing support tubes 16 are fitted with stanchions 18 that, in the illustrated case, are hollow sheet metal weldments. The stanchions 18 are vertically extending, relatively narrow four-sided wedges. More specifically, each side of a stanchion 18 has a portion that lies in a flat plane and has a profile of a truncated isosceles triangle. At a lower end, a stanchion 18 has a horizontal cylindrical steel sleeve 19 proportioned to receive a respective support bearing tube 16 with a slip fit.

The stanchions 18 are releasably locked on the outer end of a respective bearing support tube 16 with a "hitch pin" 21 received in aligned holes in the sleeve 19 and tube 16. A pin 21 can be manually removed and installed without need of a tool. A spring biased detent ball in the pin 21 assures that the pin stays in a tube 16 and sleeve 19 unless the pin is forcibly manually pulled by way of an attached finger grip ring.

Figure 10:
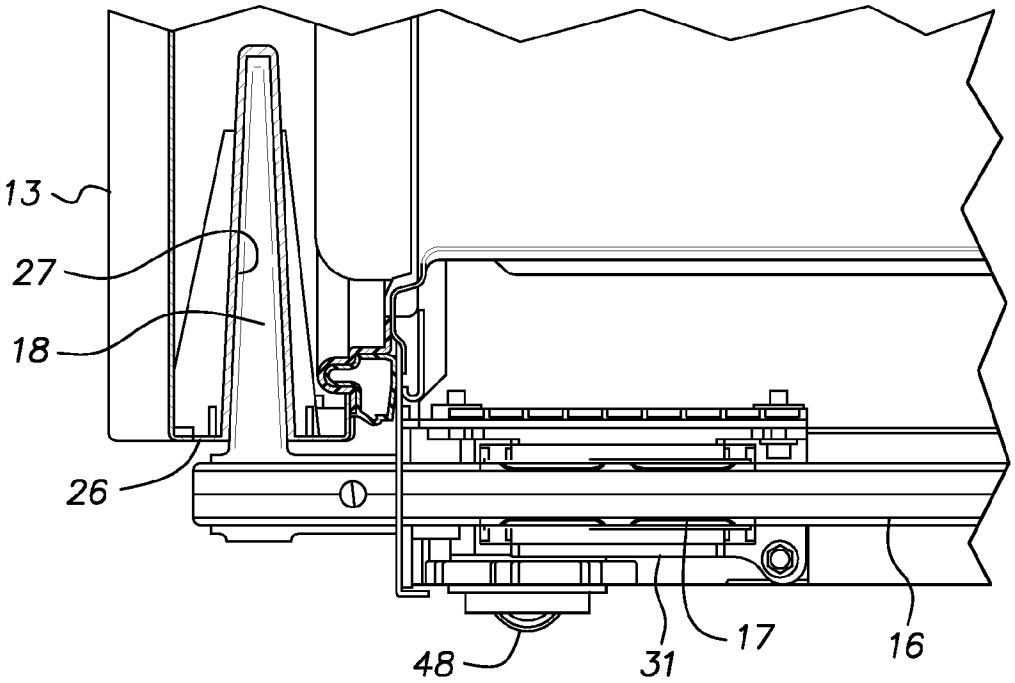
FIG. 10 is a fragmentary sectional view of the lower left of the refrigeration appliance taken in a plane within the freezer door and perpendicular to a bearing support tube.
Figure 9:
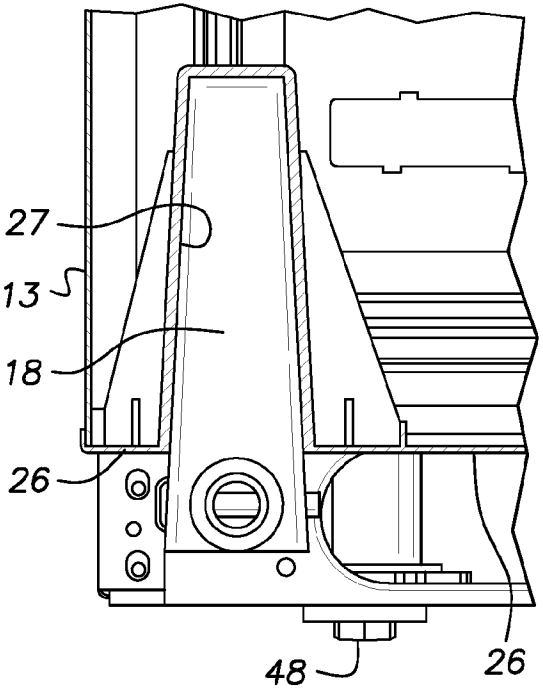
FIG. 9 is an elevational sectional view of the lower left of the refrigeration appliance taken in a plane along the axis of the bearing support tubes.

The lower door 13 is a hollow structure, typically an injection molded assembly of suitable plastic(s). A bottom wall 26 of the lower door 13 is molded or otherwise provided with surface structure in the form of female cavities 27 that can each have a shape complementary to the shape of the stanchions 18 to fit tightly over a respective one of the stanchions 18. The complementary taper geometry of the stanchions 18 received in the door 13 and receiving cavities 27 (FIGS. 9 and 10) of the lower door wall 26 can assure a friction fit when the door is fully seated on the stanchions 18 to secure the door on the stanchions and minimize or eliminate free play between these elements. The vertical height of the stanchions 18 is preferably a major fraction of the height of the door 13, being, for example, at least ⅕ and preferably ¼ or more of the door height. A spring latch may be provided to further retain the door on the stanchions. For example a flexible part of the stanchion can have a detent that engages a slot or hole in the cavity and have a flange accessible from below the door for manual release of the latch.

Figure 11:
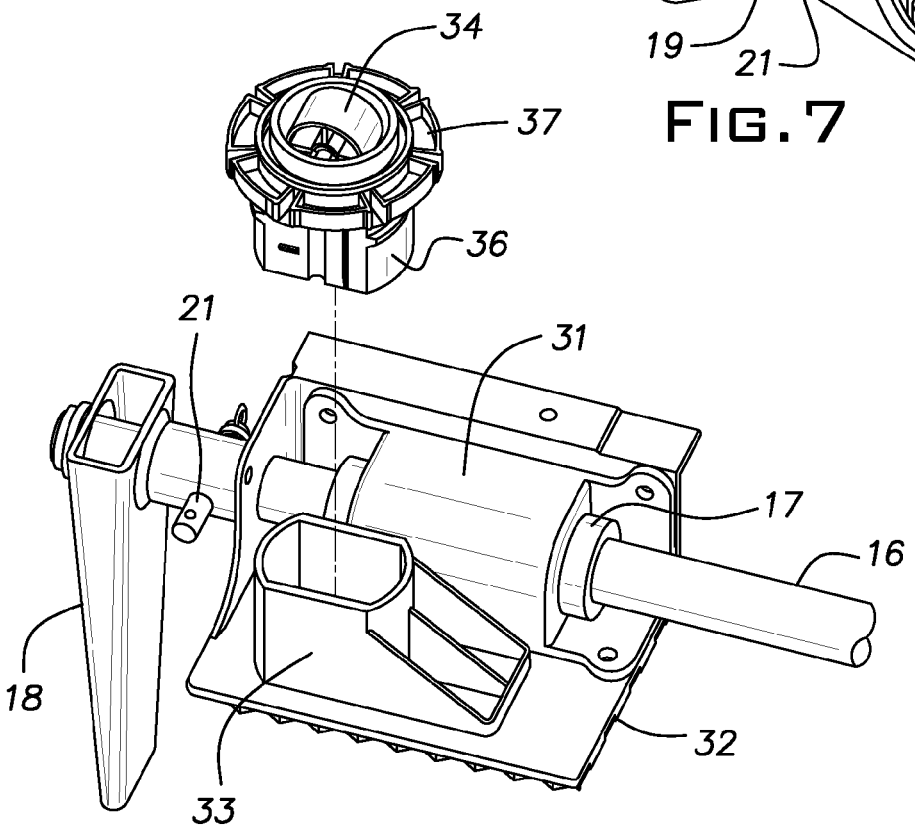
FIG. 11 is an isometric view of the door and basket support bearing and an exploded floor roller mounting arrangement.
Figure 8:
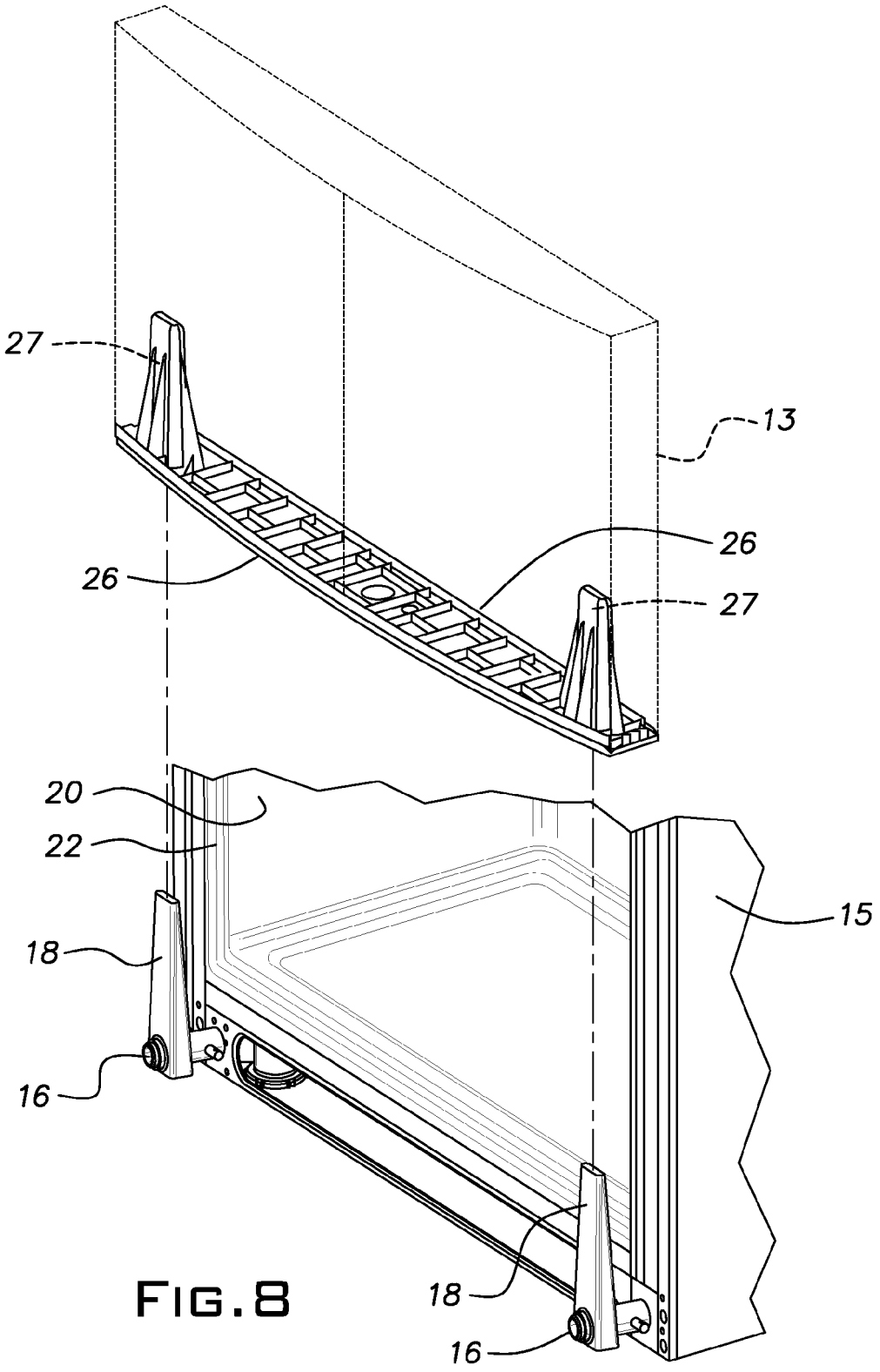
FIG. 8 is a fragmentary isometric exploded view of the freezer door and support stanchions.

FIG. 11 illustrates the right hand bearing support tube 16. The linear bearing 17 is disposed in a support block 31, which may be a metal die casting that is bolted to both legs of a right angle or L-shaped molded plastic foot bracket 32. Immediately adjacent the support block 31 is a molded plastic roller support 33 fixed on the foot bracket 32. A floor roller 34, is journalled in an externally threaded tube 36 of D-shaped cross-section complementary to the interior of the roller support 33. The height of the roller 34 is adjusted by turning a circular nut 37 threaded onto the tube 36. It will be understood that the weight of the freezer basket 14 and its contents is largely transferred to the roller 34 through the foot bracket 32.

Figure 12:
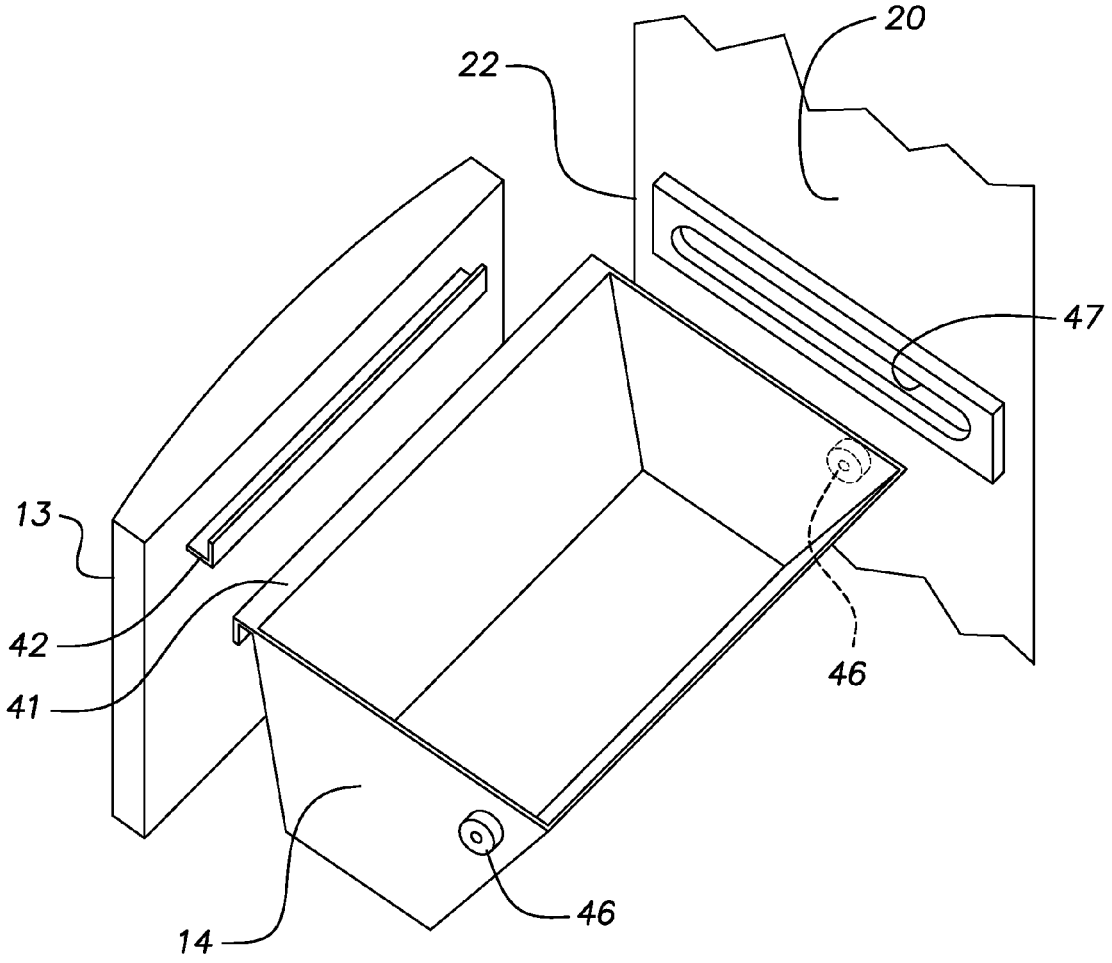
FIG. 12 is a schematic isometric view of the freezer basket, freezer door, and freezer liner.

Referring to FIG. 12, the relationship of the freezer basket 14 and freezer door 13 is schematically illustrated. A forward edge 38 of the basket 14 is releasably coupled to a rear face 39 of the freezer door 13. In the illustrated arrangement, coupling between the basket 14 and door 13 is accomplished by a pair of interlocking retention hooks 41, 42. The retention hook 41 on the basket extends downwardly while the retention hook 42 on the door 13 faces upwardly. This arrangement allows the basket to be decoupled from the freezer door 13 by simply lifting the forward edge of the basket 14 relative to the door 13 and moving it slightly to the rear. The hooks 41 and 42, when interengaged, can be arranged, as shown, such that the front of the basket 14 is supported on the bearing support tubes 16 and ultimately the bearings 17 through the door 13. Alternatively, the front of the basket 14 can be supported directly on bearing support tubes 16. The rear of the basket 14 is supported in the freezer compartment by rollers 46 journalled on the outer sides of the basket and operating in roller tracks 47 provided in the liner 20 of the freezer compartment. Once decoupled from the basket 14, the freezer door 13 can be removed from the remainder of the appliance 10 by simply manually lifting it off the stanchions 18 and can be reinstalled by simply lowering back onto the stanchions.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refrigerator appliance including a cabinet enclosing an upper chamber and a lower chamber, the lower chamber having a container for holding goods, the container being slidably mounted to the appliance for movement through an opening in the cabinet between a closed position within the cabinet and an open position at least partially out of the cabinet, a door associated with the container adapted to close the cabinet opening when the container is in the closed position and move away from the cabinet opening when the container is moved to the open position, the door being supported by a pair of horizontal slides located externally of the lower chamber, the door being supported on the horizontal slides independently of the container.

2. A refrigeration appliance as set forth in claim 1, wherein the horizontal slides are round tubes supported in linear bearings.

3. A refrigeration appliance as set forth in claim 1, wherein said horizontal slides carry vertically oriented stanchions received in said door.

4. A refrigeration appliance as set forth in claim 3, wherein said stanchions are tapered and are received in complementary-shaped receiving areas in said door.

5. A refrigeration appliance as set forth in claim 4, wherein said tapered stanchions are each tapered along four converging planes.

6. A refrigerator as set forth in claim 3, wherein said stanchions are removably mounted on said horizontal slides.

7. A refrigerator including a cabinet having a bottom mounted freezer container, a separate bearing on left and right sides of the refrigerator cabinet adapted to support the container for movement in and out of a freezer compartment of the cabinet, the separate bearings being disposed outside of a freezer liner forming the freezer compartment.

8. A refrigerator as set forth in claim 7, wherein said bearings lie in a plane below the freezer liner.

9. A refrigerator as set forth in claim 8, wherein said bearings are linear, said bearings carrying horizontal support tubes.

10. A refrigerator as set forth in claim 9, wherein said tubes are cylindrical.

11. A refrigerator as set forth in claim 9, wherein outer ends of said tubes are fitted with vertical stanchions.

12. A refrigerator as set forth in claim 11, wherein a door adapted to close a cabinet opening through which said basked passes is fitted over said stanchions in a manner enabling removal of said door from said stanchions by lifting said door off of said stanchions.

13. A refrigerator as set forth in claim 12, wherein said stanchions are tapered and said door has internal surfaces complementary to the taper of said stanchions whereby the door is adapted to fit on said stanchions without free play therebetween.

14. A refrigerator as set forth in claim 13, wherein said stanchions are removably held on said tubes by pins capable of being gripped by a person's fingers for removal from said stanchions and tubes.

15. A refrigerator as set forth in claim 7, including floor rollers, each roller being mounted on a common bracket with a respective one of said bearings, said brackets being disposed below a freezer liner forming said freezer compartment.

16. A refrigerator as set forth in claim 15, wherein said bracket is primarily L-shaped having perpendicular horizontal and vertical legs.

17. A refrigerator as set forth in claim 16, wherein said bearings are disposed in housings, said housings being attached to both said horizontal and vertical legs of said bracket.

18. A refrigeration appliance having an upper refrigeration compartment closed by vertically hinged door and a lower freezer compartment with a horizontally slidable container and closed by a door removably attached to the container, an elongated support element horizontally disposed below the freezer compartment at each side of the freezer compartment, a bearing supporting an associated elongated support element for horizontal movement, the elongated support elements supporting the door and container for translatory opening and closing movement away from and towards the freezer compartment, the door being mounted on vertical stanchions fixed to outer ends of the elongated support elements, the door, stanchions and elongated support elements being constructed and arranged to permit the door to be dismounted from the stanchions by a simple lifting motion vertically away from the elongated support elements.

19. A refrigeration appliance as set forth in claim 18, wherein the bearings are mounted on the appliance externally and below the freezer compartment.

20. A refrigeration appliance as set forth in claim 19, wherein said stanchions are removably attached to their respective elongated elements with pins inserted in aligned holes in the stanchions and the elongated support elements.

21. A refrigeration appliance as set forth in claim 18, wherein the stanchions are of a height that is at least ⅕ the height of the freezer compartment door.

22. A refrigeration appliance as set forth in claim 21, wherein the stanchions are tapered and the door is provided with surfaces complementary to the taper of the stanchions.

* * * * *